US005611820A

United States Patent [19]

Ouziel

[11] Patent Number: 5,611,820

[45] Date of Patent: Mar. 18, 1997

[54] PROCESS FOR DYEING WOOL-CONTAINING FIBRE MATERIALS

[75] Inventor: Philippe Ouziel, Altkirch, France

[73] Assignee: Ciba-Geigy Corporation, Tarrytown, N.Y.

[21] Appl. No.: 554,422

[22] Filed: Nov. 6, 1995

[30] Foreign Application Priority Data

Nov. 8, 1994 [CH] Switzerland ..... 3338/94
May 18, 1995 [CH] Switzerland ..... 1474/95

[51] Int. Cl.[6] ..... D06P 1/60; D06P 3/852

[52] U.S. Cl. ..... 8/533; 8/552; 8/576; 8/586; 8/594; 8/597; 8/598; 8/601; 8/611; 8/917

[58] Field of Search ..... 8/552, 532, 576, 8/586, 594, 597, 598, 601, 611, 917

[56] References Cited

U.S. PATENT DOCUMENTS 5,376,145 12/1994 Brady et al. ..... 8/128.1

FOREIGN PATENT DOCUMENTS

89/01541 2/1989 WIPO .

*Primary Examiner*—Margaret Einsmann
*Attorney, Agent, or Firm*—Kevin T. Mansfield

[57] ABSTRACT

The invention relates to a process for dyeing wool-containing fibre materials with anionic dyes, which comprises dyeing said materials in the presence of a wool protective agent containing at least one compound of formula

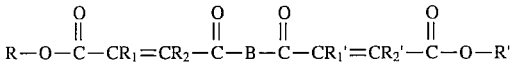

(1)

or

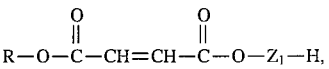

(1')

wherein the variables are as claimed in the claims. Rubfast level dyeings with no impairment of wool quality are obtainable by said process.

14 Claims, No Drawings

PROCESS FOR DYEING WOOL-CONTAINING FIBRE MATERIALS

The present invention relates to a novel process for the high-temperature dyeing of wool or wool-containing fibre materials.

It is known in the art to dye wool or wool-containing fibre materials in the presence of dyeing assistants so as to counteract fibre damage that occurs in particular in high-temperature dyeing. Many of the known dyeing assistants contain formaldehyde or release formaldehyde upon heating, which is a matter for concern from the toxicological viewpoint.

Surprisingly, an improved process for the high-temperature dyeing of wool-containing fibre materials has now been found that is based on the use of a novel class of wool protective agents.

Accordingly, the invention provides a process for dyeing wool-containing fibre materials with anionic dyes, which comprises dyeing said materials in the presence of a wool protective agent containing at least one compound of formula $$R-O-\overset{\overset{\displaystyle O}{\|}}{C}-CR_1=CR_2-\overset{\overset{\displaystyle O}{\|}}{C}-B-\overset{\overset{\displaystyle O}{\|}}{C}-CR_1'=CR_2'-\overset{\overset{\displaystyle O}{\|}}{C}-O-R' \quad (1)$$

or $$R-O-\overset{\overset{\displaystyle O}{\|}}{C}-CH=CH-\overset{\overset{\displaystyle O}{\|}}{C}-O-Z_1-H, \quad (1')$$

wherein R and R' are each independently of the other hydrogen, $C_1$–$C_6$alkyl or a cation, $R_1$, $R_2$, $R_1'$ and $R_2'$ are each independently of one another hydrogen, $C_1$–$C_6$alkyl or halogen, B is a radical of formula $$-X-Z_1- \quad (2a),$$

$$-X-Z_2- \quad (2b) \text{ or}$$

$$-NR_3-(alk)-Z_1-(alk)_{0-1}-NR_3'- \quad (2c),$$

X is a functional group —O— or —$NR_3$—, $R_3$ and $R_3'$ are each independently of the other hydrogen or $C_1$–$C_6$alkyl, $Z_1$ is a radical of formula $$-(CH_2-CH_2-O)_p-(CHY_1-CHY_2-O)_q-(CHY_3-CHY_4-O)_r- \quad (3),$$

one of $Y_1$ and $Y_2$ is methyl and the other is hydrogen, one of $Y_3$ and $Y_4$ is ethyl and the other is hydrogen, p, q and r are each independently of each other an integer from 0 to 20, and the sum of (p+q+r) is from 2 to 20, $Z_2$, if X is —$NR_3$—, is the radical of a tri-, tetra- or polyamine, whose free amino groups are partially or completely in the form of an acylamino group of formula $$-NR_3-CO-CR_1''=CR_2''-CO-O-R'' \quad (4a),$$

or, if X is —O—, is the radical of a tri-, tetra- or polyol, whose free hydroxyl groups are partially or completely in the form of an ester group of formula $$-O-CO-CR_1''=CR_2''-CO-O-R'' \quad (4b),$$

R" independently has the meaning of R, and $R_1''$ and $R_2''$ have each independently of the other the meaning of $R_1$ and $R_2$, and (alk) is a $C_1$–$C_4$alkylene radical which may be further substituted.

$C_1$–$C_6$Alkyl is typically methyl, ethyl, n-propyl or isopropyl, n-, iso-, sec- or tert-butyl, or straight-chain or branched pentyl or hexyl. Cations will be understood to mean e.g. alkali meal cations or alkaline earth metal cations such as the sodium, potassium, lithium, calcium or magnesium cation, the ammonium cation or organic ammonium cations such as the mono-, di- or triethanolammonium cation. Halogen is typically fluoro, bromo or, preferably, chloro. $C_1$–$C_4$Alkylene is typically methylene, 1,1- or 1,2-ethylene, 1,2- or 1,3-propylene, or 1,2-, 1,3-, 1,4- or 2,3-butylene.

R or R' in the significance of an alkyl radical is preferably a $C_1$–$C_4$alkyl radical and, particularly preferably, methyl or ethyl.

If R or R' is a cation, then it is preferably an alkali metal cation, typically the sodium, potassium or lithium cation, the ammonium cation, or the cation of an organic amine, e.g. the mono-, di- or triethanolammonium cation. R or R' defined as cation are particularly preferably each independently of the other the sodium, potassium or triethanolammonium cation.

R and R' are each independently of the other preferably hydrogen or a cation and, partiucarly preferably, hydrogen or the sodium or potassium cation.

R and R' are preferably identical.

$R_1$, $R_2$, $R_1'$ and $R_2'$ are each independently of one another preferably hydrogen, $C_1$–$C_4$alkyl or chloro. $R_1$, $R_2$, $R_1'$ and $R_2'$ are preferably identical. In a particularly preferred embodiment of this invention $R_1$, $R_2$, $R_1'$ and $R_2'$ are each hydrogen.

$R_3$ and $R_3'$ are each independently of the other preferably hydrogen or $C_1$–$C_4$alkyl and, more preferably, hydrogen, methyl or ethyl. $R_3$ and $R_3'$ are preferably identical. In a particularly preferred embodiment of this invention $R_3$ and $R_3'$ are each hydrogen.

X is preferably the functional group —O—.

p, q and r are each independently of one another preferably an integer from 0 to 8, and the sum of (p+q+r) is from 2 to 8.

Particularly preferred radicals $Z_1$ are those of formula $$-(CH_2-CH_2-O)_p-(CHY_1-CHY_2-O)_q- \quad (3a),$$

wherein $Y_1$ and $Y_2$ have the meaning given above, and p and q are each independently of the other an integer from 0 to 8, and the sum of (p+q) is from 2 to 8.

$Z_1$ is preferably a radical of formula $$-(CH_2-CH_2-O)_p- \quad (3b),$$

wherein p is an integer from 2 to 8 and, preferably, from 2 to 5.

In formulae (4*a*) and (4*b*), R" has independently the preferred meanings given above for R, and R" and $R_2''$ have each independently of the other the preferred meanings given above for $R_1$ and $R_2$. R" preferably has the same meaning as R and R'; and $R_1''$ and $R_2''$ preferably have the same meaning as $R_1$, $R_1'$, $R_2$ and $R_2'$.

$Z_2$ defined as the radical of a tri-, tetra- or polyamine or tri-, tetra- or polyol, contains preferably ≦12 carbon atoms and, particularly preferably, 3 to 8 carbon atoms.

Illustrative examples of suitable tri-, tetra- or polyol radicals $Z_2$ are glycerol, diglycerol, triglycerol, 1,1,1-tris(hydroxymethyl)propane, erythritol, pentaerythritol, arabitol, sorbitol or mannitol, wherein free hydroxyl groups are partially or completely in the form of an ester group of the above formula (4*b*).

A group of particularly suitable radicals of the above formula (2*b*) is that wherein X is a —O— group, and $Z_2$ is the radical of a tri-, tetra-, penta- or hexaol of 3 to 6 carbon atoms and, preferably, the radical of a tri- or tetraol of 3 or 4 carbon atoms, whose free hydroxyl groups are partially or completely in the form of an ester group of the above formula (4*b*).

Radicals of formula (2*b*) are particularly preferably glycerol radicals of formula $$\begin{array}{l} -O-CH_2 \\ \quad\ \ | \\ \quad\ \ CH-O-CO-CH=CH-COOR'', \\ \quad\ \ | \\ \quad\ \ CH_2-O- \end{array} \qquad (2b')$$

wherein R" is hydrogen or a cation. If B in formula ( 1 ) is defined as a radical of the above formula (2*b*'), then R, R' and R" are preferably identical.

$Z_1$ in formula (2*c*) has the meanings and preferred meanings given for formula (2*a*), and $R_3$' independently has the meanings and preferred meanings given above for $R_3$. If the alkylene radical (alk) is substituted, then typically by a hydroxy, $C_1$–$C_4$alkoxy or sulfato radical. The (alk) group is preferably a $C_2$–$C_4$alkylene radical which is unsubstituted or substituted by hydroxy, $C_1$–$C_4$alkoxy or —$OSO_3H$ and, particularly preferably, the 1,2-ethylene, 1,2- or 1,3-propylene or 2-hydroxy-1,3-propylene radical.

If B is a radical of the above formula (2*c*), then it preferably corresponds to a a radical of formula $$-NR_3-(alk)-(CH_2-CH_2-O)_p-(CHY_1-CHY_2-O)_q-(alk)_{0-1}-NR_3' \quad (2c'),$$

wherein $R_3$ and $R_3$' are identical and are each hydrogen, methyl or ethyl, (alk) is a $C_2$–$C_4$alkylene radical which is unsubstituted or substituted by hydroxy, $C_1$–$C_4$alkoxy or —$OSO_3H$; $Y_1$ and $Y_2$ have the meaning indicated above, and p and q are each independently of the other an integer from 0 to 8, and the sum of (p+q) is from 2 to 8.

B defined as a radical of formula (2*c*) is particularly preferably a radical of formula $$NH-(alk)-(CH_2-CH_2-O)_p-(alk)_{0-1}-NH \quad (2c''),$$

wherein (alk) is 1,2-ethylene, 1,2- or 1,3-propylene or 2-hydroxy-1,3-propylene, and p is an integer from 2 to 8 and, preferably, from 2 to 5.

Of particular interest for the process of this invention are compounds of the above formula (1), wherein B is a radical of the above formula (2*a*) or (2*b*), and X is a functional group —O—.

Particularly interesting are also compounds of the above formula (1'), wherein R is hydrogen or a cation, and $Z_1$ is a radical of the above formula (3*a*) or, preferably, formula (3*b*).

A preferred embodiment of the invention relates to the process using a compound of the above formula (1), wherein R and R' are identical and are each hydrogen or a cation, $R_1$, $R_2$, $R_1$' and $R_2$' are identical and are each hydrogen, $C_1$–$C_4$alkyl or chloro, B is a radical of formula $$-O-(CH_2-CH_2-O)_p-(CHY_1-CHY_2-O)_q-(CHY_3-CHY_4-O)_r \quad (2a') \text{ or}$$

$$-O-Z_2-O- \quad (2b'')$$

one of $Y_1$ and $Y_2$ is methyl and the other is hydrogen, one of $Y_3$ and $Y_4$ is ethyl and the other is hydrogen, p, q and r are each independently of one another an integer from 0 m 8, and the sum of (p+q+r) is from 2 to 8, $Z_2$ is the radical of a tri-, tetra- or polyol of 3 to 12 carbon atoms, whose free hydroxyl groups are partially or completely in the form of an ester group of formula $$-O-CO-CR_1''=CR_2''-CO-O-R'' \quad (4b),$$

and

R" has the meaning of R, and $R_1$" and $R_2$" each have the meaning of $R_1$ and $R_2$.

In a particularly preferred embodiment of the invention the process is carried out using a compound of formula $$R-O-\overset{O}{\overset{\|}{C}}-CH=CH-\overset{O}{\overset{\|}{C}}-B-\overset{O}{\overset{\|}{C}}-CH=CH-\overset{O}{\overset{\|}{C}}-O-R, \qquad (1a)$$

wherein R is hydrogen or a cation, B is a radical of formula $$-O-(CH_2-CH_2-O)_p-(CHY_1-CHY_2-O)_q- \quad (2a'') \text{ or}$$

$$-O-Z_2-O- \quad (2b''),$$

one of $Y_1$ and $Y_2$ is methyl and the other is hydrogen, p and q are each independently of the other an integer from 0 to 8, and the sum of (p+q) is from 2 to 8, and $Z_2$ is the radical of a tri-, tetra- or polyol of 3 to 6 carbon atoms, whose free hydroxyl group is partially or completely in the form of an ester group of formula $$-O-CO-CH=CH-CO-O-R \quad (4b'),$$

wherein R has the meaning given above.

In a particularly preferred embodiment of the invention the process is carried out using a compound of formula $$R-O-\overset{O}{\overset{\|}{C}}-CH=CH-\overset{O}{\overset{\|}{C}}-B-\overset{O}{\overset{\|}{C}}-CH=CH-\overset{O}{\overset{\|}{C}}-O-R, \qquad (1a)$$

wherein B is a radical of formula $$-O-(CH_2-CH_2-O)_p- \quad (2a^*),$$

R is hydrogen or the sodium or potassium cation, and p is an integer from 2 to 5.

The compounds of formula (1) used in the practice of this invention can be prepared in per se known manner, typically by reacting a compound of formula $$H-B'-H \quad (5),$$

wherein B' is a radical of formula $$-X-Z_1- \quad (2a),$$

$$-X-Z_2-X- \quad (2b) \text{ or}$$

$$-NR_3-(alk)-Z_1-(alk)_{0-1}-NR_3'- \quad (2c),$$

X, $Z_1$, $R_3$, $R_3$' and (alk) each have the meaning given above, and $Z_2$, if X is —$NR_3$—, is the radical of a tri-, tetra- or polyamine, or, if X is —O—, is the radical of a tri-, tetra- or polyol, in any succession with the acid hydrides or monoacid chlorides of carboxylic acids of formulae $$R-O-\overset{O}{\overset{\|}{C}}-CR_1=CR_2-\overset{O}{\overset{\|}{C}}-OH, \quad (6a)$$

$$HO-\overset{O}{\overset{\|}{C}}-CR_1'=CR_2'-\overset{O}{\overset{\|}{C}}-O-R' \quad (6b)$$

and $$HO-\overset{O}{\overset{\|}{C}}-CR_1''=CR_2''-\overset{O}{\overset{\|}{C}}-O-R'', \quad (6c)$$

wherein R, R', R", $R_1$, $R_1'$, $R_1''$, $R_2$, $R_2'$ and R" each have the meaning given above.

The preferred compounds of formula (1), wherein R, R' and R", $R_1$, $R_1'$ and $R_1''$, and $R_2$, $R_2'$ and $R_2''$ are each identical, can advantageously be prepared by reacting a compound of formula (5) with an acid anhydride or monoacid chloride of a carboxylic acid of the above formula (6*a*) in molar excess.

The particularly preferred compounds of formula (1), wherein R, R', R" are each hydrogen or a cation, and $R_1$, $R_1'$, $R_1''$, $R_2$, $R_2'$ and $R_2''$ are each hydrogen, can advantageously be prepared by reacting a compound of formula (5) with maleic acid anhydride in molar excess.

The reaction of the compound of formula (5) with the compounds of formula (6*a*), (6*b*) and (6*c*) is preferably carried out at elevated temperature, e.g. in the range from 15° to 150° C. and, preferably, from 80° to 120° C. The reaction time can vary within a wide range, a reaction time of c. 1 to 10 hours and, preferably, from 1 to 5 hours having been found viable.

The preparation of the compounds of formula (1') can be carried out in analogous manner, typically by reacting the acid halide or acid anhydride of a compound Of the above formula (6*a*), wherein $R_1$ and $R_2$ are each hydrogen, with about equimolar amounts of a compound of the above formula (5), wherein B' is a radical of formula (2*a*), wherein X is —O—.

The products of formulae (1) and (1') obtained in the reaction can be used as wool protective agents either direct or, for example, after dilution with one or more than one suitable solvent. Solvents suitable as diluents are typically water or alkylene glycols or alkylene glycol ethers which are liquid at room temperature, e.g. polyethylene glycol 200, propylene glycol, diethylene glycol, dipropylene glycol, triethylene glycol, tripropylene glycol or the monomethyl, monoethyl, monobutyl, dimethyl, diethyl or dibutyl ethers thereof, typically diethylene glycol monomethyl ethers or diethylene glycol monoethyl ethers, diethylene glycol dimethyl ethers or diethylene glycol diethyl ethers, ethylene glycol monobutyl ethers or ethylene glycol dibutyl ethers, or diethylene glycol monobutyl ethers or diethylene glycol dibutyl ethers. It is preferred to use alkylene glycols as diluents for the novel wool protective agents.

The compounds of formulae (5), (6*a*), (6*b*) and (6*c*) are known per se or can be prepared according to methods known per se.

The wool protective agents used according to this invention can contain one or more than one compound of formula (1). One embodiment of the invention comprises using a wool protective agent containing at least one compound of each of formulae (1) and (1'). It is also possible to use wool protective agents containing a compound of formula (1) or (1') and a further compound having wool protective properties, typically 3-chloro-1,2-propanediol.

The procedure is typically carded out by first pretreating the wool-containing fibre material with the wool protective agent in an aqueous bath and then dyeing it by adding the dye to this bath. The procedure can also be carried out by treating the goods to be dyed concurrently with the wool protective agent and the dye in an aqueous bath.

It has been found viable to use the wool protective agent in an amount of typically 0.1 to 20% by weight, preferably of 0.1 to 10% by weight, more particularly of 1 to 10% by weight, and most preferably, of 1 to 6% by weight, based on the weight of the goods to be dyed.

The wool-containing fibre material may be wool itself or may consist typically of wool/polyamide or wool/polyester blends. Wool/synthetic polyamide blends are preferably dyed with anionic dyes, and wool/polyester blends are preferably dyed with disperse and anionic dyes. Those skilled in the art will be familiar with suitable anionic and disperse dyes.

The fibre material may be in any form of presentation, typically as yarns, flocks, slubbing, knitted goods, bonded fibre fabrics or, preferably, wovens.

The blended fabrics are preferably wool/polyester blends that normally contain 20 to 50 parts by weight of wool and 80 to 50 parts by weight of polyester. The preferred blends for the process of this invention contain 45 parts of wool and 55 parts of polyester.

The liquor to goods ratio in the inventive process can vary over a wide range and is typically 1:1 to 1:100 and, preferably, 1:10 to 1:50.

In addition to containing the dye, water and the wool protective agent, the dyebath may contain further customary ingredients, conveniently selected from among mineral acids, organic acids and/or salts thereof which serve to adjust the pH of the dyebath, and also electrolytes, levelling agents, wetting agents and antifoams, as well as—for dyeing wool/polyester blends—carriers and/or dispersants.

The pH of the dyebath may conveniently be in the range from 4 to 6.5 and, preferably, from 5.2 to 5.8. The novel process is normally carried out in the temperature range from 60° to 130° C.

If the material to be dyed is wool alone, dyeing is preferably carried out by the exhaust process, typically in the temperature range from 60° to 106° C., preferably from 95° to 98° C. The dyeing time can vary, depending on the requirements, but is preferably 60–120 minutes.

Polyester/wool blends are conveniently dyed in a single bath from an aqueous liquor by the exhaust process. Dyeing is preferably carried out by the high-temperature process in closed, pressure-resistant apparatus at temperatures above 100° C., conveniently from 110° to 125° C. and, preferably, from 118° to 120° C., under normal or elevated pressure.

The blended fabrics can also be dyed by the customary carrier dyeing process at temperatures below 106° C., conveniently in the temperature range from 75° to 98° C., in the presence of one or more than one carrier.

The dyeing of the polyester/wool blends can be carried out such that the goods to be dyed are treated first with the wool protective agent and, if appropriate, the carrier, and then dyed. The procedure may also be such that the goods to be dyed are treated simultaneously with the wool protective agent, the dyes and optional dyeing assistants. The preferred procedure comprises putting the textile material into a bath that contains the wool protective agent and further optional dyeing assistants and which has a temperature of 40°–50° C., and treating the material for 5 to 15 minutes at this temperature. Afterwards the temperature is raised to c. 60°–70° C., the dye is added, the dyebath is slowly heated to dyeing temperature and dyeing is carried out for c. 20–60 minutes, preferably for 30 to 45 minutes, at this temperature.

At the conclusion, the liquor is cooled to about 60° C. and the dyed material is finished in customary manner.

By means of the novel process it is possible to dye wool or, preferably, wool/polyester blends at elevated temperature with full protection of the wool component, i.e. maintaining the important fibre properties of the wool, including tear strength, burst strength and elongation. It also merits special mention that the polyester component of blended fabrics exhibits no yellowing.

An additional advantange of the novel process is the reduction of setting which is achieved by the presence of a compound of formula (1) or (1') in the dye bath. By setting is meant an unwanted fixation of the wool fibres occurring during the dyeing process and which is caused by rearrangement of the disulfide bridges in the wool. Such unwanted fixations can result in deformation (flattening) of the wool yarns on spools, in compaction of the wool fibres as well as in loss of volume of the wool.

The antisetting effect of a wool protective agent can be determined, inter alia, in general accordance with A. M. Wemys and M. A. White, Proc. Ind. Japan-Australia, Joint Symp. on objective measurement, Kyoto (1985), page 165, by punching out circles from woolen test fabric, folding these circles in the middle and sewing them together at the edge. The samples are then dyed compressed in the presence of the wool protective agent. The samples are then opened and one thread each is pulled out. After a relaxation time in warm water, the angle of the threads is is measured. The more the previously compressed yarn has opened and the more the angle approximates 180°, the better the antisetting effect of the wool protective agent. An angle of c. 120° to 180° and, preferably, of 140° to 180° indicates a good antisetting effect.

The following Examples in which parts and percentages are by weight illustrate the invention.

PREPARATION OF THE WOOL PROTECTIVE AGENTS

Example 1: A sulfonation flask is charged with 285 parts of polyethylene glycol 200, 279 parts of maleic acid anhydride and 2 parts of tributylamine. The batch is cautiously heated to c. 100° C. and then stirred for c. 5 hours at this temperature. The titration of the carboxyl groups indicates the end of the reaction. 560 parts of the product of formula $$\text{HOOC—CH=CH—CO—O—(CH}_2\text{—CH}_2\text{—O)}_4\text{—CO—CH=CH—COOH}$$

are obtained as a viscous oil, which is then formulated with dipropylene glycol to a solution having an active content of 70%.

Example 2: A sulfonation flask is charged with 18.4 parts of glycerol, 55.9 parts of maleic acid anhydride and 0.3 parts of tributylamine. The batch is cautiously heated to c. 100° C. and then stirred for c. 5 hours at this temperature. The titration of the carboxyl groups indicates the end of the reaction. The batch is cooled to c. 50° C., diluted with 40 parts of water and neutralised to pH 6 by the addition of c. 303 parts of 2N sodium hydroxide solution. Undissolved particles are removed by filtration, to give the compound of formula $$\begin{array}{l} \text{NaOOC—HC=HC—OC—O—CH}_2 \\ \qquad\qquad\qquad\qquad\quad | \\ \qquad\qquad\qquad\qquad\quad \text{CH}_2\text{—O—CO—CH=CH—COONa} \\ \qquad\qquad\qquad\qquad\quad | \\ \qquad\qquad\qquad\qquad\quad \text{CH}_2\text{—O—CO—CH=CH—COONa} \end{array}$$

as 20% solution.

Example 3: A sulfonation flask is charged with 53.7 parts of dipropylene glycol, 74.5 parts of maleic anhydride and 0.8 parts of tributylamine. The batch is cautiously heated to c. 100° C. and stirred for c. 5 hours at this temperature. The titration of the carboxyl groups indicates the end of the reaction. 125 parts of the product of formula $$\text{HOOC—CH=CH—CO—O—[CH(CH}_3\text{)—CH}_2\text{—O]}_2\text{—CO—CH=CH—COOH}$$

are obtained as a viscous oil.

Example 4: A sulfonation flask is charged with 53.1 parts of diethylene glycol, 93.1 parts of maleic acid anhydride and 1 parts of tributylamine. The batch is cautiously heated to c. 100° C. and then stirred for c. 5 hours at this temperature. The titration of the carboxyl groups indicates the end of the reaction. 140 parts of the product of formula $$\text{HOOC—CH=CH—CO—O—(CH}_2\text{—CH}_2\text{—O)}_2\text{—CO—CH=CH—COOH}$$

are obtained as a viscous oil.

Example 5: A sulfonation flask is charged with 20.1 parts of 1,1,1-trihydroxymethylpropane, 41.9 parts of maleic acid anhydride and 0.3 parts of tributylamine. The batch is cautiously heated to c. 100° C. and then stirred for c. 5 hours at this temperature. The titration of the carboxyl groups indicates the end of the reaction. 58 parts of the product of formula $$\begin{array}{l} \qquad\qquad\quad \text{CH}_2\text{—O—CO—CH=CH—COOH} \\ \qquad\qquad\quad | \\ \text{H}_3\text{C—H}_2\text{C—C—CH}_2\text{—O—CO—CH=CH—COOH} \\ \qquad\qquad\quad | \\ \qquad\qquad\quad \text{CH}_2\text{—O—CO—CH=CH—COOH} \end{array}$$

are obtained as a viscous oil.

Example 5*a:* A sulfonation flask is charged with 25.5 parts of tetraethylene glycol, 11.9 parts of maleic acid anhydride and 0.12 parts of tributylamine. The batch is cautiously heated to c. 100° C. and then stirred for c. 5 hours at this temperature. The titration of the carboxyl groups indicates the end of the reaction. 37.5 parts of the product of formula $$\text{HOOC—CH=CH—CO—O—(CH}_2\text{—CH}_2\text{—O)}_4\text{—H}$$

are obtained as a viscous oil, which is then formulated with 16.1 parts of dipropylene glycol to a solution having an active content of 70%.

Example 5*b:* A sulfonation flask is charged with 62.5 parts of the compound of formula $H_2N—(CH_2CH_2O)_{23}—CH_2CH_2—NH_2$ (e.g. Jeffamine®ED 900), 11.2 parts of maleic acid anhydride and 0.3 parts of tributylamine. The batch is cautiously heated to c. 100° C. and then stirred for c. 2 hours at this temperature. The titration of the carboxyl groups indicates the end of the reaction. About 70 parts of the product of formula $$\text{HOOC—CH=CH—CO—NH—(CH}_2\text{—CH}_2\text{—O)}_{23}\text{—CH}_2\text{—CH}_2\text{—NH—CO—CH=CH—COOH}$$

are obtained as a viscous oil.

Example 5*c:* A sulfonation flask is charged with 47.9 parts of polyethylene glycol 600, 14.9 parts of maleic acid anhydride and 0.3 parts of tributylamine. The batch is cautiously heated to c. 100° C. and stirred for c. 5 hours at this temperature and then for a further 1 hour at 120° C. The titration of the carboxyl groups indicates the end of the reaction. 60 parts of the product of formula $$\text{HOOC—CH—CH—CO—O—(CH}_2\text{—CH}_2\text{O)}_{13}\text{—CO—}$$

CH=CH—COOH are obtained as a viscous oil.

DYEING EXAMPLES

Example 6: 100 parts of a blended fabric consisting of 50% of polyester and 45% of wool are pretreated for 5 minutes at 40° C. in a circulation dyeing machine with a liquor comprising 2.0 parts of the product of Example 1, 0.5 part of a sulfated fatty amine polyglycol ether, 1.0 part of a commercial assistant mixture (based on carboxylic acid and phosphoric acid aromatic compounds), and 2.0 parts of sodium acetate in 1200 parts of water, and which is adjusted to pH 5.5 with acetic acid. The liquor is heated over 30 minutes to 120° C., adding to the liquor at 70° C. 2.0 parts of the dye mixture consisting of 1.6% by weight of the dye of formula

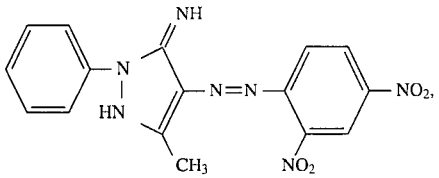

60% by weight of the dye of formula

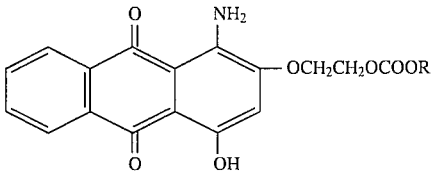

(R = 50% —$CH_2$—$CH_3$ + 50% —$C_6H_5$), 5.0% by weight of the dye of formula

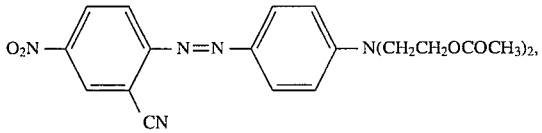

4.0 parts of the dye of formula

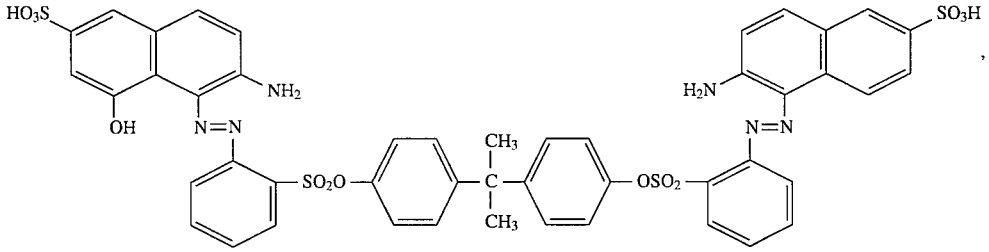

3.3 parts of the dye of formula

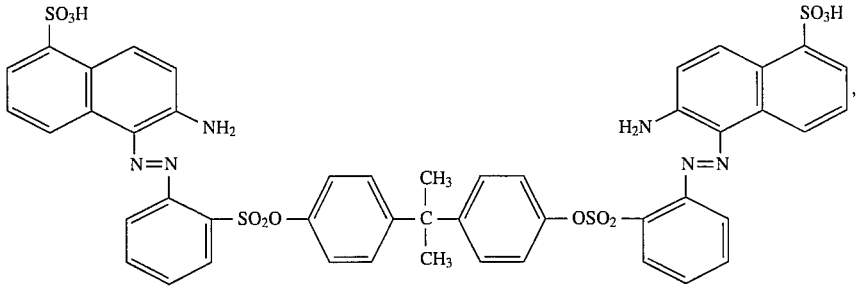

15.0 parts of the dye of formula

-continued

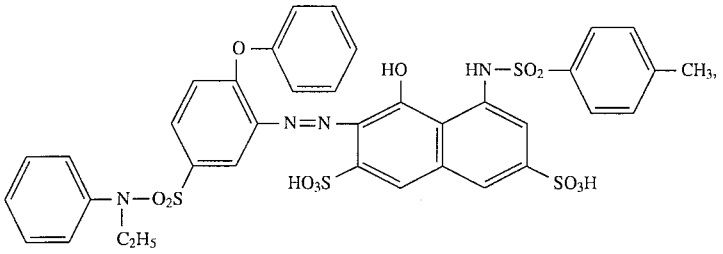

and 10 parts of sodium sulfate.

Dyeing is then carried out for 40 minutes at 120° C. and the dye liquor is afterwards cooled to 60° C. The dyed material is given a conventional washing-off, giving a rubfast, level red tone-in-tone dyeing with no impairment of wool quality.

Replacing the aqueous formulation of Example 1 with 1.5 parts of the product of Example 2 or with 1.5 parts of the product of Example 3 or with 2.0 parts of the product of Example 4 or with 5.0 parts of the product of Example 5, also gives dyeings having good properties and with no impairment of the wool quality.

Example 6*a:* The procedure of Example 6 is repeated, but replacing the aqueous formulation of Example 1 with 1.7 parts of a mixture consisting of 93 parts of the product of Example 1 and 7 parts of 3-chloro- 1,2-propanediol, to give a dyeing which also has good properties and with no impairment of wool quality.

Example 6*b:* The procedure of Example 6 is repeated, but replacing the aqueous formulation of Example 1 with 2 parts of a mixture consisting of 50 parts of the product of Example 1 and 50 parts of the product of Example 5*a,* to give a dyeing which also has good properties and with no impairment of wool quality.

Example 7: 100 parts of a wool fabric having a weight of 180 g/m$^2$ are treated in 1000 parts of an aqueous liquor containing 4 parts of ammonium sulfate, 2.0 parts of the product of Example 1 and 0.5 parts of a naphthalene-sulfonic acid condensate for 10 minutes at 50° C., the pH having first been adjusted to c. 6 with acetic acid. To this liquor are added 3 parts of the dye of formula

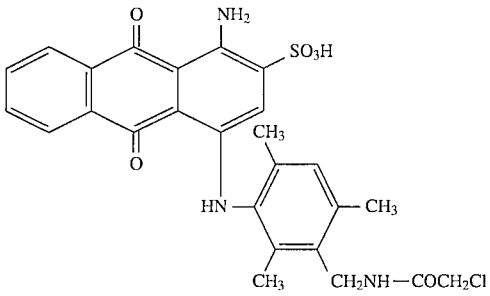

and treatment is continued for a further 5 minutes. The dye liquor is then heated over c. 45 minutes to c. 98° C. and the fabric is dyed at this temperature for 60 minutes. The liquor is then allowed to cool to c. 60° C. and the dyed fabric is rinsed in conventional manner and dried, giving a rubfast, level blue dyeing with no impairment of wool quality.

Replacing the aqueous formulation of Example 1 with 1.5 parts of the product of Example 2 or with 1.5 parts of the product of Example 3 or with 2.0 parts of the product of Example 4 or with 5.0 parts of the product of Example 5, gives a dyeing which also has good properties and with no impairment of wool quality.

Example 7*a:* The procedure of Example 7 is repeated, but replacing the aqueous formulation of Example 1 with 1.7 parts of a mixture consisting of 93 parts of the product of Example 1 and 7 parts of 3-chloro-1,2-propanediol, to give a dyeing which also has good properties and with no impairment of wool quality.

Example 7*b:* The procedure of Example 7 is repeated, but, replacing the aqueous formulation of Example 1 with 2 parts of a mixture consisting of 50 parts of the product of Example 1 and 50 parts of the product of Example 5*a,* to give a dyeing which also has good properties and with no impairment of wool quality.

What is claimed is:

1. A process for dyeing wool-containing fibre materials with anionic dyes, which comprises dyeing said materials in the presence of a wool protective agent containing at least one compound of formula $$R-O-\overset{\overset{\displaystyle O}{\|}}{C}-CR_1=CR_2-\overset{\overset{\displaystyle O}{\|}}{C}-B-\overset{\overset{\displaystyle O}{\|}}{C}-CR_1'=CR_2'-\overset{\overset{\displaystyle O}{\|}}{C}-O-R' \quad (1)$$

wherein R and R' are each independently of the other hydrogen, $C_1$–$C_6$alkyl or a cation, $R_1$, $R_2$, $R_1'$ and $R_2'$ are each independently of one another hydrogen, $C_1$–$C_6$alkyl or halogen, B is a radical of formula $$-X-Z_1- \quad (2a),$$

$$-X-Z_2- \quad (2b) \text{ or}$$

$$-NR_3-(alk)-Z_1-(alk)_{0-1}-NR_3'- \quad (2c),$$

X is a functional group —O— or —$NR_3$—, $R_3$ and $R_3'$ are each independently of the other hydrogen or $C_1$–$C_6$alkyl, $Z_1$ is a radical of formula $$-(CH_2-CH_2-O)_p-(CHY_1-CHY_2-O)_q-(CHY_3-CHY_4-O)_r- \quad (3),$$

one of $Y_1$ and $Y_2$ is methyl and the other is hydrogen, one of $Y_3$ and $Y_4$ is ethyl and the other is hydrogen, p, q and r are each independently of each other an integer from 0 to 20, and the sum of (p+q+r) is from 2 to 20, $Z_2$, if X is —$NR_3$—, is the radical of a tri-, tetra- or polyamine, whose free amino groups are partially or completely in the form of an acylamino group of formula $$-NR_3-CO-CR_1''=CR_2''-CO-O-R'' \quad (4a),$$

or, if X is —O—, is the radical of a tri-, tetra- or polyol, whose free hydroxyl groups are partially or completely in the form of an ester group of formula $$-O-CO-CR_1''=CR_2''-CO-O-R'' \quad (4b),$$

R" independently has the meaning of R, and $R_1$" and $R_2$" have each independently of the other the meaning of $R_1$ and $R_2$, and (alk) is a $C_1$–$C_4$alkylene radical which is further unsubstituted or substituted.

2. A process according to claim 1, wherein R, R' and R" are identical and are each hydrogen or a cation.

3. A process according to claim 1, wherein $R_1$, $R_1$', $R_1$", $R_2$, $R_2$', $R_2$", $R_3$, $R_3$' and $R_3$" are identical and are each hydrogen.

4. A process according to claim 1, wherein B is a radical of formula (2*a*) or (2*b*) as shown in claim 1, and X is a functional group —O—.

5. A process according to claim 1, wherein $Z_1$ is a radical of formula $$-(CH_2-CH_2-O)_p-(CHY_1-CHY_2-O)_q- \quad (3a),$$

wherein $Y_1$ and $Y_2$ are as indicated in claim 1, and p and q are each independently of the other an integer from 0 to 8, and the sum of (p+q) is from 2 to 8.

6. A process according to claim 1, wherein $Z_1$ is a radical of formula $$-(CH_2-CH_2-O)_p- \quad (3b),$$

wherein p is an integer from 2 to 8.

7. A process according to claim 1, wherein X is a —O— group, and $Z_2$ is the radical of a tri-, tetra-, penta- or hexaol of 3 to 6 carbon atoms, whose free hydroxyl groups are partially or completely in the form of an ester group of the formula (4*b*) as indicated in claim 1.

8. A process according to claim 1, wherein X is a —O— group, and $Z_2$ is a glycerol radical of formula $$\begin{array}{l} -O-CH_2 \\ \quad\;\; | \\ \quad\;\; CH-O-CO-CH=CH-COOR", \\ \quad\;\; | \\ \quad\;\; CH_2-O- \end{array} \quad (2b')$$

wherein R" is hydrogen or a cation.

9. A process for dyeing wool-containing fibre materials with anionic dyes according to claim 1, which comprises dyeing said materials in the presence of a wool protective agent containing at least one compound of formula (1) as shown in claim 1, wherein R and R' are identical and are each hydrogen or a cation, $R_1$, $R_2$, $R_1$' and $R_2$' are identical and are each hydrogen, $C_1$–$C_4$alkyl or chloro, B is a radical of formula $$-O-(CH_2-CH_2-O)_p-(CHY_1-CHY_2-O)_q-(CHY_3-CHY_4-O)_r \quad (2a') \text{ or}$$

$$-O-Z_2-O- \quad (2b'')$$

one of $Y_1$ and $Y_2$ is methyl and the other is hydrogen, one of $Y_3$ and $Y_4$ is ethyl and the other is hydrogen, p, q and r are each independently of one another an integer from 0 to 8, and the sum of (p+q+r) is from 2 to 8, $Z_2$ is the radical of a tri-, tetra- or polyol of 3 to 12 carbon atoms, whose free hydroxyl groups are partially or completely in the form of an ester group of formula $$-O-CO-CR_1"=CR_2"-CO-O-R" \quad (4b),$$

and

R" has the meaning of R, and $R_1$" and $R_2$" each have the meaning of $R_1$ and $R_2$.

10. A process for dyeing wool-containing fibre materials with anionic dyes according to claim 1, which comprises dyeing said materials in the presence of a wool protective agent containing at least one compound of formula $$R-O-\overset{O}{\overset{\|}{C}}-CH=CH-\overset{O}{\overset{\|}{C}}-B-\overset{O}{\overset{\|}{C}}-CH=CH-\overset{O}{\overset{\|}{C}}-O-R, \quad (1a)$$

wherein R is hydrogen or a cation, B is a radical of formula $$-O-(CH_2-CH_2-O)_p-(CHY_1-CHY_2-O)_q- \quad (2a'') \text{ or}$$

$$-O-Z_2-O- \quad (2b''),$$

one of $Y_1$ and $Y_2$ is methyl and the other is hydrogen, p and q are each independently of the other an integer from 0 to 8, and the sum of (p+q) is from 2 to 8, and $Z_2$ is the radical of a tri-, tetra- or polyol of 3 to 6 carbon atoms, whose free hydroxyl group is partially or completely in the form of an ester group of formula $$-O-CO-CH=CH-CO-O-R \quad (4b'),$$

wherein R has the meaning given above.

11. A process for dyeing of wool-containing fibre materials with anionic dyes according to claim 1, which comprises dyeing said materials in the presence of a wool protective agent containing at least one compound of formula $$R-O-\overset{O}{\overset{\|}{C}}-CH=CH-\overset{O}{\overset{\|}{C}}-B-\overset{O}{\overset{\|}{C}}-CH=CH-\overset{O}{\overset{\|}{C}}-O-R, \quad (1a)$$

wherein B is a radical of formula $$-O-(CH_2-CH_2-O)_p- \quad (2a^*),$$

R is hydrogen or the sodium or potassium salt, and p is an integer from 2 to 5.

12. A process for dyeing wool-containing fibre materials with anionic dyes according to claim 1, which comprises dyeing said materials in the presence of a wool protective agent containing at least one compound of formula (1) as claimed in claim 1.

13. A process according to claim 1, which comprises dyeing the wool-containing fibre material in the presence of 0.1 to 10% by weight of one or more than one compound of formula (1), based on the goods to be dyed.

14. A process according to claim 1 for dyeing wool/polyester blends by the exhaust process.

* * * * *